US009313864B2

(12) United States Patent
Setomoto et al.

(10) Patent No.: US 9,313,864 B2
(45) Date of Patent: Apr. 12, 2016

(54) ILLUMINATION CONTROL SYSTEM, CONTROL APPARATUS, AND ILLUMINATION CONTROL METHOD

(71) Applicant: Panasonic Intellectual Property Management Co., Ltd., Osaka (JP)

(72) Inventors: Tatsumi Setomoto, Osaka (JP); Tamotsu Ando, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/735,586

(22) Filed: Jun. 10, 2015

(65) Prior Publication Data

US 2016/0037614 A1 Feb. 4, 2016

(30) Foreign Application Priority Data

Jul. 29, 2014 (JP) ..... 2014-154243

(51) Int. Cl.
*H05B 37/02* (2006.01)

(52) U.S. Cl.
CPC ..... *H05B 37/0272* (2013.01); *H05B 37/02* (2013.01)

(58) Field of Classification Search
CPC ..... H05B 37/02
USPC ..... 315/291, 297, 307, 308, 312
See application file for complete search history.

(56) References Cited

U.S. PATENT DOCUMENTS

| | | | | |
|---|---|---|---|---|
| 9,055,256 | B2 * | 6/2015 | Friedlander | H04N 5/4403 |
| 2006/0028212 | A1 | 2/2006 | Steiner et al. | |
| 2006/0135204 | A1 | 6/2006 | Angelhag | |
| 2014/0015415 | A1 * | 1/2014 | Lim | H05B 37/02 315/131 |
| 2015/0022123 | A1 * | 1/2015 | Van De Sluis | H05B 37/0245 315/312 |
| 2015/0123566 | A1 * | 5/2015 | Tyson | H05B 37/02 315/294 |

FOREIGN PATENT DOCUMENTS

| | | |
|---|---|---|
| JP | 08-098264 | 4/1996 |
| JP | 2001-230087 | 8/2001 |
| JP | 2006-020016 | 1/2006 |
| JP | 2007-527129 | 9/2007 |
| JP | 2008-509478 | 3/2008 |
| JP | 4523590 | 6/2010 |
| JP | 2012-074147 | 4/2012 |
| WO | WO 2004/112321 A1 | 12/2004 |
| WO | WO 2006/017613 A1 | 2/2006 |

* cited by examiner

*Primary Examiner* — Tung X Le
(74) *Attorney, Agent, or Firm* — Renner, Otto, Biosselle & Sklar, LLP

(57) ABSTRACT

Illumination control system 1 includes illumination apparatuses 10 and control apparatus 20 for controlling them. Each illumination apparatus 10 includes: communication unit 101 that performs wireless communication with control apparatus 20; and controller 102 that receives from control apparatus 20 instruction on operation and causes illumination apparatus 10 to perform the instructed operation. Control apparatus 20 includes: communication unit 201 that establishes connection to perform wireless communication with illumination apparatuses 10; display unit 202 that displays an icon representing target illumination apparatus 10; second controller 203 that transmits instruction on operation of target illumination apparatus 10 to enable a user to visually confirm target illumination apparatus 10; receiver 204 that receives from the user an identifier identifying a group of target illumination apparatus 10 in association with the icon; and registration unit 205 that registers group information indicating the identified group and connection information in association with each other.

9 Claims, 10 Drawing Sheets

ILLUMINATION CONTROL SYSTEM, CONTROL APPARATUS, AND ILLUMINATION CONTROL METHOD

CROSS REFERENCE TO RELATED APPLICATION

The present application is based on and claims priority of Japanese Patent Application No. 2014-154243 filed on Jul. 29, 2014. The entire disclosure of the above-identified application including the specification, drawings and claims is incorporated herein by reference in its entirety.

BACKGROUND OF THE INVENTION

1. Field of the Invention

The present disclosure relates to illumination control systems, illumination control apparatuses, and illumination control methods.

2. Description of the Related Arts

There are illumination systems in which a control apparatus controls operations of one or more illumination apparatuses through communication. If such an illumination system is provided in a home, office, or the like, a plurality of illumination apparatuses are divided into groups so that illumination apparatuses in the same group can be controlled together. Furthermore, the control apparatus appropriately generates connection information concerning connection with each of the illumination apparatuses in communication, and holds the generated connection information.

Moreover, Japanese patent publication No. 4523590 discloses a control method by which a control apparatus causes an illumination apparatus to emit colored light to enable a user to visually recognize the illumination apparatus.

SUMMARY OF THE INVENTION

Conventionally, such connection information concerning connection between a control apparatus and each of illumination apparatuses and group information concerning grouping of the illumination apparatuses are generated according to user's operations. Therefore, the user has to do complicated operations to generate these pieces of information by respective different procedures.

An object of the present disclosure is to provide an illumination control system and the like which are capable of generating and registering such connection information and group information of a target illumination apparatus by simpler operations.

In order to solve the above-described conventional problem, according to an aspect of the present disclosure, there is provided an illumination control system including: a plurality of illumination apparatuses; and a control apparatus that controls the plurality of illumination apparatuses, wherein each of the plurality of illumination apparatuses includes: a first communication unit that performs wireless communication with the control apparatus; and a first controller that receives from the control apparatus an instruction on an operation of the illumination apparatus via the first communication unit, and causes the illumination apparatus to perform the operation according to the instruction received, and the control apparatus includes: a second communication unit capable of performing the wireless communication with the plurality of illumination apparatuses individually, the second communication unit establishing connection for the wireless communication with a target illumination apparatus among the plurality of illumination apparatuses and perform the wireless communication with the target illumination apparatus; a display unit that displays an icon representing the target illumination apparatus that is a partner in the connection established; a second controller that transmits an instruction on an operation of the target illumination apparatus via the second communication unit to enable a user to visually confirm the target illumination apparatus; a receiver that receives from the user an identifier for identifying a group which is associated with the icon, the group being a unit for controlling one or more illumination apparatuses including the target illumination apparatus among the plurality of illumination apparatuses; and a registration unit that registers group information and connection information in association with each other when the receiver receives the identifier, the group information indicating the group identified by the identifier received by the receiver, and the connection information indicating the connection established by the second communication unit.

According to the present disclosure, it is possible to generate and register connection information and group information of a target illumination apparatus by simpler operations.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

DETAILED DESCRIPTION OF THE PREFERRED EMBODIMENT(S)

Figure 1:
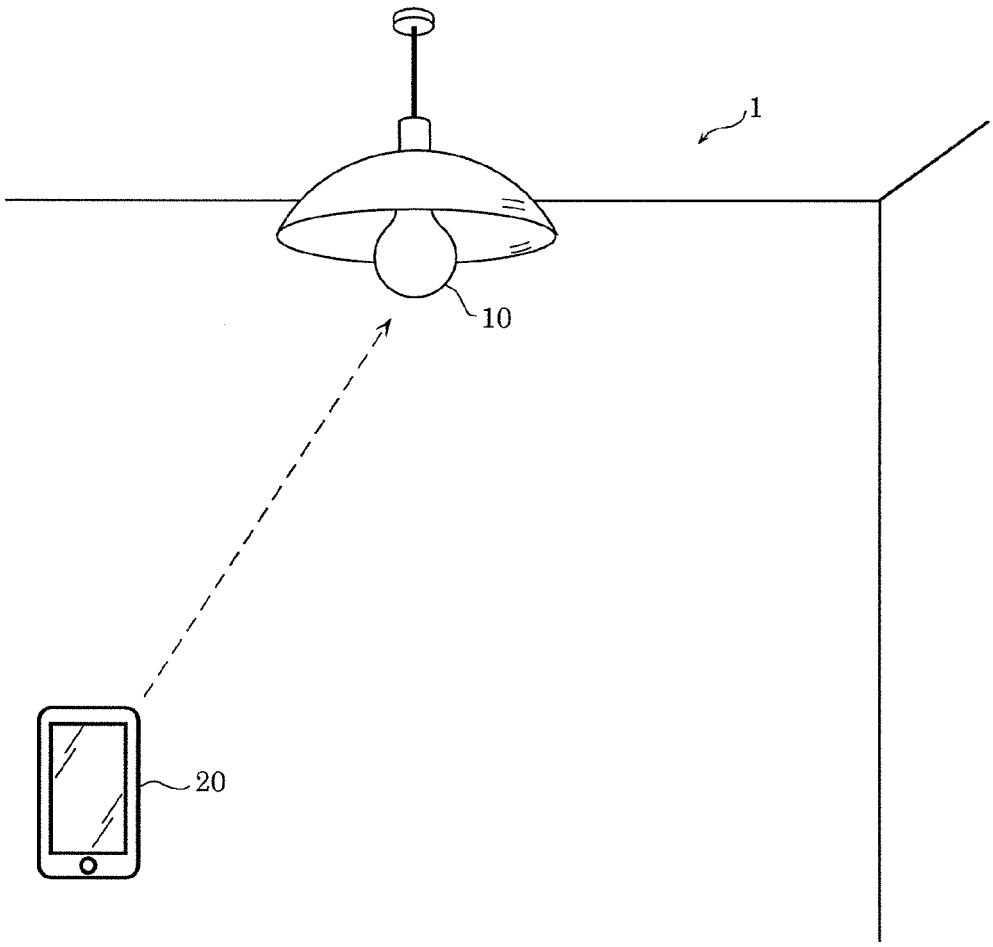
FIG. 1 is an overview of an illumination control system according to an embodiment.

Hereinafter, a certain exemplary embodiment is described in greater detail with reference to the accompanying Drawings. It should be noted that the embodiment described below is a specific example of the present disclosure. Numerical values, shapes, materials, constituent elements, arrangement positions and the connection configuration of the constituent elements, steps, the order of the steps, and the like described in the following embodiment are merely examples. They are therefore not intended to limit the present disclosure. Therefore, among the constituent elements in the following embodiment, constituent elements that are not described in independent claims that show the most generic concept of the present disclosure are described as elements constituting more desirable configurations, although such constituent elements are not necessarily required to achieve the object of the present disclosure.

It should be noted that each of the figures in the Drawings are merely explanatory and not exact illustration. Furthermore, the same reference numerals are assigned to identical constitutional elements through the Drawings.

Embodiment

In the present embodiment, the description is given to an illumination control system and the like which generate and register connection information and group information of a target illumination apparatus by simpler operations.

[1. Overview]

FIG. 1 is an overview of illumination control system 1 according to the present embodiment.

As illustrated in FIG. 1, illumination control system 1 according to the present embodiment includes illumination apparatuses 10 and control apparatus 20. In FIG. 1, one of illumination apparatuses 10 is illustrated as a representative.

Each of illumination apparatuses 10 illuminates a space in which illumination apparatus 10 is equipped, when supplied with power to be switched ON. Hereinafter, switching ON, switching OFF, and the like, which are performed by each illumination apparatus 10, are referred to also as "operations" of illumination apparatus 10. The "operations" will be described in more detail later.

Each of illumination apparatuses 10 wirelessly communicates with control apparatus 20. Each illumination apparatus 10 receives instructions on operations of illumination apparatus 10 from control apparatus 20 through the wireless communication, and then performs the operations according to the received instructions.

Control apparatus 20 controls illumination apparatuses 10. Control apparatus 20 wirelessly communicates with illumination apparatuses 10. Examples of control apparatus 20 include a smartphone or advanced mobile phone terminal, a mobile phone terminal, a tablet terminal, a dedicated controller terminal, and a personal computer (PC).

[2. Functional Configuration]

Figure 2:
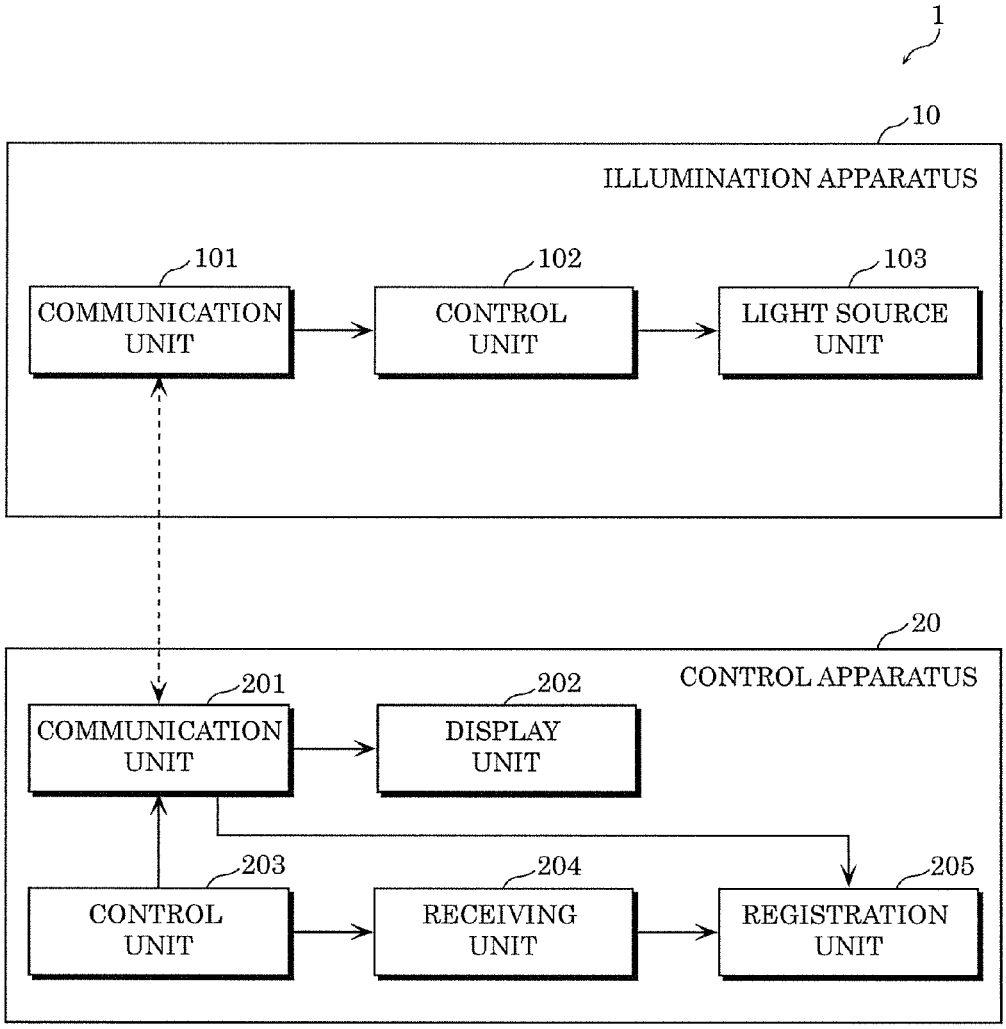
FIG. 2 is a block diagram illustrating a functional configuration of the illumination control system according to the present embodiment.

FIG. 2 is a block diagram illustrating a functional configuration of illumination control system 1 according to the present embodiment.

As illustrated in FIG. 2, each of illumination apparatuses 10 includes communication unit 101, controller 102, and light source unit 103.

Communication unit 101 is an interface for wireless communication. Communication unit 101 establishes connection for wireless communication with a communication partner prior to the wireless communication. More specifically, communication unit 101 establishes connection for wireless communication with control apparatus 20. Communication unit 101 corresponds to the first communication unit according to the aspect of the present disclosure.

An example of the wireless communication is wireless communication according to Bluetooth (registered trademark). In wireless communication according to Bluetooth (registered trademark), the establishment of connection for wireless communication is called pairing. Hereinafter, it is assumed that Bluetooth (registered trademark) is adopted as a standard for wireless communication, and the apparatuses establish connection by paring to wirelessly communicate with each other. It should be noted that wireless communication may be according to other communication standards, such as Local Area Network (LAN) according to IEEE802.11a, b, g, ZigBee, Z-Wave, or KNX.

It should also be noted that the above-described wireless communication includes not only direct wireless communication between communication unit 101 and control apparatus 20 but also indirect communication via another device (referred to also as "multihop communication"). An apparatus that performs multihop communication transfers a communication packet received from a wireless communication partner to another wireless communication partner, and holds information of the path used for the transfer. The communication path in multihop communication may be in a star topology, a tree topology, or a mesh topology.

Controller 102 receives instructions on operations of target illumination apparatus 10 from control apparatus 20 via communication unit 101, and causes target illumination apparatus 10 to perform the operation according to the received instructions. Here, the "operations of illumination apparatus 10" includes: switching ON by emitting illumination light from illumination apparatus 10; switching OFF by not emitting illumination light; blinking by repeating switching ON and switching OFF; light intensity changing by changing or adjusting intensity of illumination light; color changing by changing or adjusting color of illumination light; and the like. Controller 102 corresponds to the first controller according to the aspect of the present disclosure.

Light source unit 103 performs switching ON, switching OFF, and other operations under the control of controller 102. Examples of light source unit 103 include an incandescent bulb, a fluorescent light, a Light Emitting Diodes (LED), and the like.

Furthermore, as illustrated in FIG. 2, control apparatus 20 includes communication unit 201, display unit 202, controller 203, receiver 204, and registration unit 205.

Communication unit 201 is an interface for wireless communication. Communication unit 201 establishes connection for wireless communication with a communication partner prior to the wireless communication. In other words, communication unit 201 establishes connection for wireless communication with each of illumination apparatuses 10. Communication unit 201 corresponds to the second communication unit according to the aspect of the present disclosure.

Display unit 202 is a display screen on which illumination icons representing respective illumination apparatuses 10 are displayed. More specifically, display unit 202 displays illumination icons representing respective illumination apparatuses 10 with which communication unit 201 has already established connection for wireless communication, thus enabling a user to visually confirm the establishment. Hereinafter, the illumination icons are referred to also simply as "icons".

Furthermore, display unit 202 displays character strings or figures for prompting the user to perform an operation on control apparatus 20. What kind of character strings or figures are displayed in which situation will be described in detail later.

Controller 203 transmits an instruction on an operation of target illumination apparatus 10 through wireless communication via communication unit 201. More specifically, controller 203 transmits an instruction on an operation of target illumination apparatus 10 and causes target illumination apparatus 10 to perform the operation according to the transmitted instruction. Examples of the above-described operation include switching ON, switching OFF, blinking, changing light intensity, and changing light color. Controller 203 corresponds to the second controller according to the aspect of the present disclosure.

As controller 203 changes an operation of target illumination apparatus 10, the user can visually confirm that target illumination apparatus 10 is designated to be controlled. Here, if there are a plurality of illumination apparatuses in a space where the user can see, controller 203 changes an operation of target illumination apparatus 10 only. Therefore, the user can visually confirm illumination apparatus 10 changing its operation as target illumination apparatus 10. It should be noted that target illumination apparatus 10 may be designated by the user or appropriately selected by controller 203.

Receiver 204 receives, from the user, selection of one of group identifiers in association with an illumination icon of target illumination apparatus 10. Group identifiers are for identifying respective groups which are units for controlling illumination apparatuses 10. More specifically, receiver 204 receives from the user selection of a group identifier for uniquely identifying a group to which target illumination apparatus 10 is to belong. Hereinafter, the group identifiers are referred to also simply as "identifiers".

For example, receiver 204 causes display unit 202 with the illumination icons to display a target illumination icon, for which a group identifier is to be selected, in a mode different from that of the other illumination icons. The user is thereby prompted to perform group identifier selection for the illumination icon displayed in the different mode. Here, receiver 204 may use any method as long as receiver 204 can receive designation of target illumination apparatus 10 and selection of the group identifier of the group to which target illumination apparatus 10 is to belong.

Furthermore, receiver 204 also receives user's operations on control apparatus 20. Timings of receiving the user's operations by receiver 204 and details of the user's operations will be described in detail later. An example of receiver 204 is a touch panel.

It should be noted that if receiver 204 and display unit 202 are implemented to a touch-panel display, receiver 204 can receive, as a user's operation, a user's touch on an item displayed on display unit 202 (referred to also as a "tap operation" or simply "tapping"). In this way, the user can perform operations intuitively.

Registration unit 205 registers: group information for specifying a group identified by a group identifier received by receiver 204; and connection information concerning connection in wireless communication. Group information indicates to which group target illumination apparatus 10 belongs. Connection information indicates a connection partner connected with control apparatus 20 in wireless communication, attribute information of the connection in the wireless communication, and the like. The registration performed by registration unit 205 is storing of the above pieces of information into a storage device in control apparatus 20 or into another storage device. The other storage device may be connected to control apparatus 20 through a communications line. Hereinafter, registering of group information is referred to also as registration of grouping, and registering of connection information is referred to also as registration of pairing.

[4. Processing]

Figure 3:
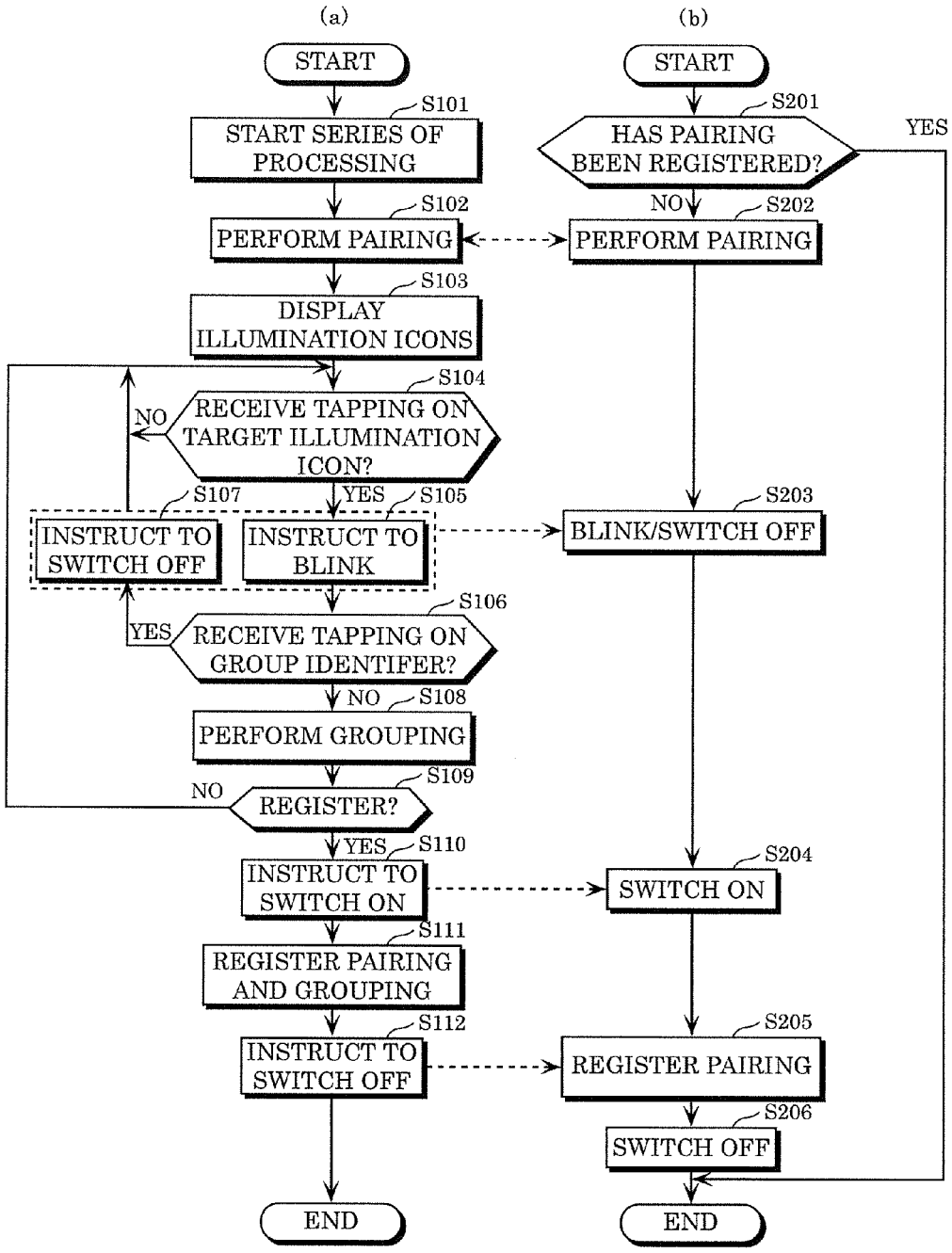
FIG. 3 is a flowchart of a series of processing performed by the illumination control system according to the present embodiment.

FIG. 3 is a flowchart of the series of processing performed by illumination control system 1 according to the present embodiment. Hereinafter, the series of processing means processing including steps from S102 to S112 in FIG. 3 up to completion of registering group information and connection information. (a) in FIG. 3 is a flowchart of processing performed by control apparatus 20.

At step S101, control apparatus 20 starts the series of processing. The starting of the series of processing means starting of steps from S102 to S112.

At the step of starting the series of processing, receiver 204 receives from the user an operation for instructing the series of processing on illumination apparatuses 10. For example, display unit 202 displays an image by which the user can start the series of processing, and when receiver 204 receives from the user an instruction for starting the series of processing through the displayed image, control apparatus 20 starts the series of processing.

Furthermore, at step S101, receiver 204 may receive selection of a type representing group identifiers from the user. The group identifiers may be anything for uniquely identifying respective groups. For example, group identifiers may be expressed as different colors, different numerals, different figures, different character images, or the like. In this case, receiver 204 receives the user's selection of one of such types of group identifiers, and control apparatus 20 therefore performs the series of processing according to the selected type.

At step S102, communication unit 201 establishes wireless communication with communication units 101 of illumination apparatuses 10, in other words, performs pairing with illumination apparatuses 10. Hereinafter, the pairing is also referred to as generation of pairing information. In the pairing, for example, control apparatus 20 is a "master" and illumination apparatuses 10 are "slaves" according to Bluetooth (registered trademark), and wireless communication between the master and each of the slaves is established.

At step S103, display unit 202 displays illumination icons corresponding to respective illumination apparatuses 10 with which control apparatus 20 has been paired at step S102. Viewing display unit 202, the user can confirm these illumination apparatuses 10 with which control apparatus 20 has been paired.

At step S104, receiver 204 is on standby for user's tapping on one of the illumination icons displayed on display unit 202. When the user taps an illumination icon corresponding to target illumination apparatus 10 among the illumination icons displayed on display unit 202, receiver 204 detects the tapping as a designation of target illumination apparatus 10 to be grouped.

If receiver 204 receives the user's tapping (Yes at step S104), then the processing proceeds to step S105. On the other hand, if receiver 204 does not receive any tapping (No at step S104), then the processing keeps on standby for receiving tapping at step S104.

At step S105, controller 203 transmits an instruction for blinking target illumination apparatus 10 to target illumination apparatus 10 via communication unit 201. When target illumination apparatus 10 blinks as instructed, the user can visually confirm that the blinking illumination apparatus is target illumination apparatus 10 of the illumination icon tapped at step S103.

At step S106, receiver 204 is on standby for user's selection of a group identifier for the tapped illumination icon displayed on display unit 202. For example, display unit 202 displays the tapped illumination icon together with group identifiers of group candidates to which target illumination apparatus 10 may belong. When the user taps one of the group identifiers displayed on display unit 202, receiver 204 detects that the user selects a group corresponding to the tapped group identifier. It should be noted that if the user already knows the above group identifiers of the group candidates, display unit 202 does not need to display the group identifiers. In this case, the user directly designates a desired group identifier by appropriate means, for example, by inputting characters or voice, and receiver 204 receives the designation.

If the receiver receives a user's selection of a group identifier by tapping it (Yes at step S106), then the processing proceeds to step S107. On the other hand, if receiver 204 does not receive any user's selection of a group identifier by tapping (No at step S106), then the processing proceeds to step S108.

At step S107, controller 203 transmits an instruction for switching OFF target illumination apparatus 10 to target illumination apparatus 10 via communication unit 201. Target illumination apparatus 10 is switched OFF as instructed. Then, the processing returns to step S104 and is on standby for receiving tapping on an illumination icon of next target illumination apparatus 10.

At step S108, registration unit 205 performs grouping for illumination apparatus(es) 10. Hereinafter, the grouping is referred to also as "generation of group information". More specifically, registration unit 205 groups illumination apparatus(es) 10 to the group(s) identified by the selected group identifier(s) which have been received by receiver 204 at step S106.

At step S109, receiver 204 is on standby for a user's operation on whether or not to terminate the grouping, in other words, whether or not to register the pairing and the grouping in the current state.

If receiver 204 receives an instruction from the user to terminate the grouping (Yes at S109), the processing proceeds to step S110. On the other hand, if receiver 204 receives an instruction from the user not to terminate the grouping (No at S109), the processing returns to step S104 and is on standby for receiving tapping on an illumination icon of next target illumination apparatus 10.

At step S110, controller 203 transmits an instruction for switching ON to illumination apparatus(es) 10 for which the registering at the following step is to be performed.

Then, at step S111, registration unit 205 registers the pairing and the grouping in association with each other. More specifically, registration unit 205 registers, for each target illumination apparatus 10, group information indicating the group selected at step S108 and connection information indicating the connection in wireless communication which is established at step S102.

Then, at step S112, controller 203 transmits to each target illumination apparatus 10 an instruction for switching OFF each target illumination apparatus 10 for which the grouping and the pairing have already been registered at step S111. By switching ON and OFF target illumination apparatus 10, control apparatus 20 can notify the user whether or not the series of processing for target illumination apparatus 10 has been appropriately performed and successfully completed.

(b) in FIG. 3 is a flowchart of processing performed by each of illumination apparatuses 10. The steps in (b) in FIG. 3 are processing performed, for example, when power is supplied to illumination apparatus 10.

At step S201, illumination apparatus 10 determines whether or not illumination apparatus 10 has already registered pairing with control apparatus 20. More specifically, illumination apparatus 10 determines whether or not illumination apparatus 10 has already registered control apparatus 20 as a connection partner connected in wireless communication.

If illumination apparatus 10 determines that the pairing has not yet been registered (No at step S201), then the processing proceeds to step S202. On the other hand, if illumination apparatus 10 determines that the pairing has already been registered (Yes at step S201), then the processing is ended.

At step S202, communication unit 101 performs pairing with communication unit 201 of control apparatus 20. This pairing is included in the pairing at step S102 in the processing performed by control apparatus 20.

Then, at each of steps S203 and S204, controller 102 causes light source unit 103 to perform an operation according to the instruction from controller 203 of control apparatus 20. More specifically, if the instruction transmitted from controller 203 at step S105 for blinking of illumination apparatus 10 is received, then controller 102 causes light source unit 103 to blink. If the instruction transmitted from controller 203 at step S107 for switching OFF illumination apparatus 10 is received, then controller 102 causes light source unit 103 to be switched OFF. If the instruction transmitted from controller 203 at step S110 for switching ON illumination apparatus 10 is received, controller 102 causes light source unit 103 to be switched ON.

At step S205, when the instruction transmitted from controller 203 at step S112 for switching OFF illumination apparatus 10 is received, controller 102 registers control apparatus 20 as a connection partner in wireless communication.

Then, at step S206, controller 102 causes light source unit 103 to be switched OFF.

As described above, the series of processing has been completed. The completion of the above-described series of processing results in the state where illumination apparatuses 10 and which group each of illumination apparatuses 10 belongs to have been registered, and pairing between control apparatus 20 and each of illumination apparatuses 10 has also been registered. As a result, control apparatus 20 can designate one of groups and then control illumination apparatuses 10 belonging to the designated group.

[5. Examples of Displayed Images Etc.]

The operations performed by control apparatus 20 and each of illumination apparatuses 10 in the series of processing of FIG. 3 are described in more detail with reference to specific examples.

Figure 4:
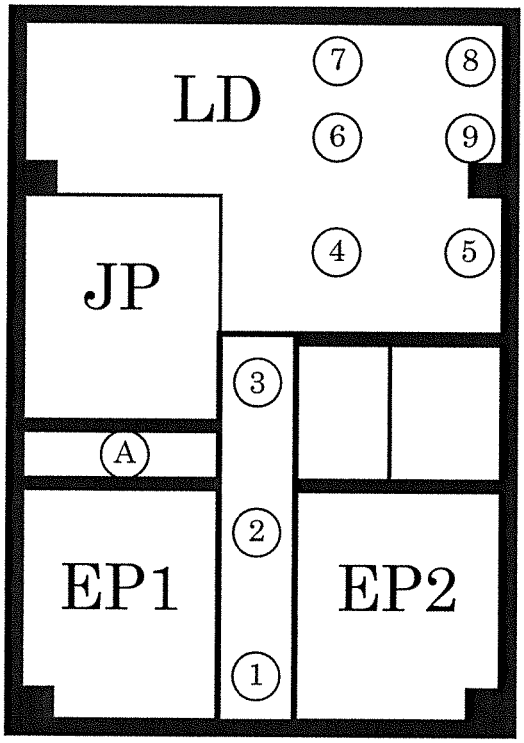
FIG. 4 is a diagram illustrating an arrangement of illumination apparatuses according to the present embodiment.

FIG. 4 is a diagram illustrating an arrangement of illumination apparatuses 10 according to the present embodiment.

FIG. 4 displays identifiers (IDs) of illumination apparatuses 10 at respective arrangement positions on a floor plan of a home having a Japanese-style room (JP), European-style rooms (EP1 and EP2), a living-dinning room (LD) which is a combination of a living room and a dining room, and a corridor. Here, the IDs are for uniquely identifying respective illumination apparatuses 10.

More specifically, it is seen that illumination apparatuses having IDs of "1" to "3" and "A" are provided in the corridor in the home, and illumination apparatuses having IDs of "4" to "9" are provided in the living-dinning room (LD).

Figure 5:
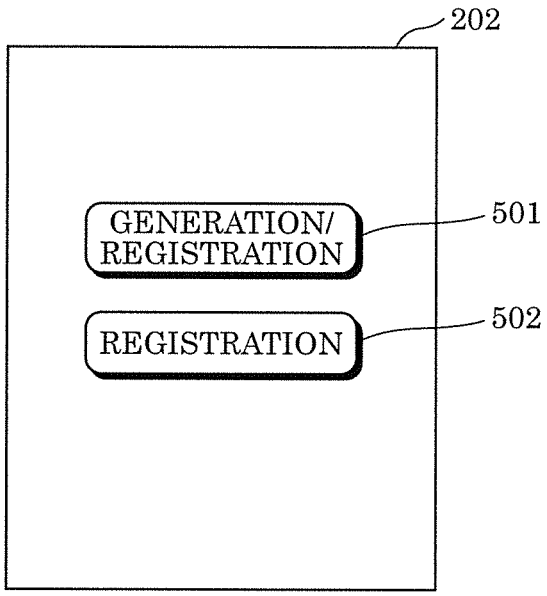
FIG. 5 is a diagram for explaining display on a display unit on which a user starts the series of processing according to the present embodiment.

FIG. 5 is a diagram for explaining display on display unit 202 on which the user starts the series of processing at step S101 according to the present embodiment. FIG. 5 is an example of the display on display unit 202 at step S101 in FIG. 3.

As illustrated in FIG. 5, display unit 202 displays generation/registration button 501 and registration button 502.

Generation/registration button 501 is a button through which receiver 204 receives from the user an instruction for starting the series of processing. When user taps generation/registration button 501, receiver 204 receives the tapping and thereby control apparatus 20 and illumination apparatus 10 start the series of processing.

Registration button 502 is a button for receiving user's instruction for registration of grouping and pairing. When the user taps registration button 502, registration unit 205 registers group information and connection information which are currently determined.

Figure 6:
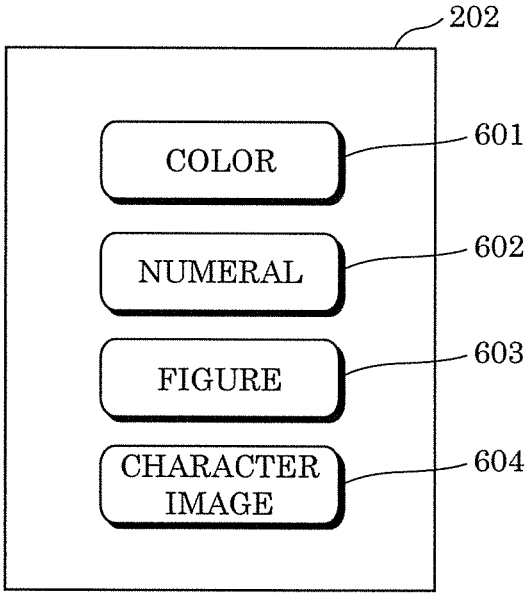
FIG. 6 is a diagram for explaining display on the display unit on which the user selects a type of group identifiers according to the present embodiment.

FIG. 6 is a diagram for explaining display on display unit 202 on which the user selects a type of group identifiers according to the present embodiment. FIG. 6 is another example of the display on display unit 202 at step S101 in FIG. 3, being different from the example of FIG. 5.

As illustrated in FIG. 6, display unit 202 displays color button 601, numeral button 602, figure button 603, and character image button 604. The above-described buttons correspond to respective types of group identifiers. For example, when receiver 204 receives user's tapping on color button 601, control apparatus 20 determines that the user selects "color" as a type representing group identifiers, and performs the series of processing according to the user's selection. Similarly, if receiver 204 receives user's tapping on numeral button 602, figure button 603, or character image button 604, then control apparatus 20 determines that the user selects "numeral", "figure", or "character image", as a type representing group identifiers.

Figure 7:
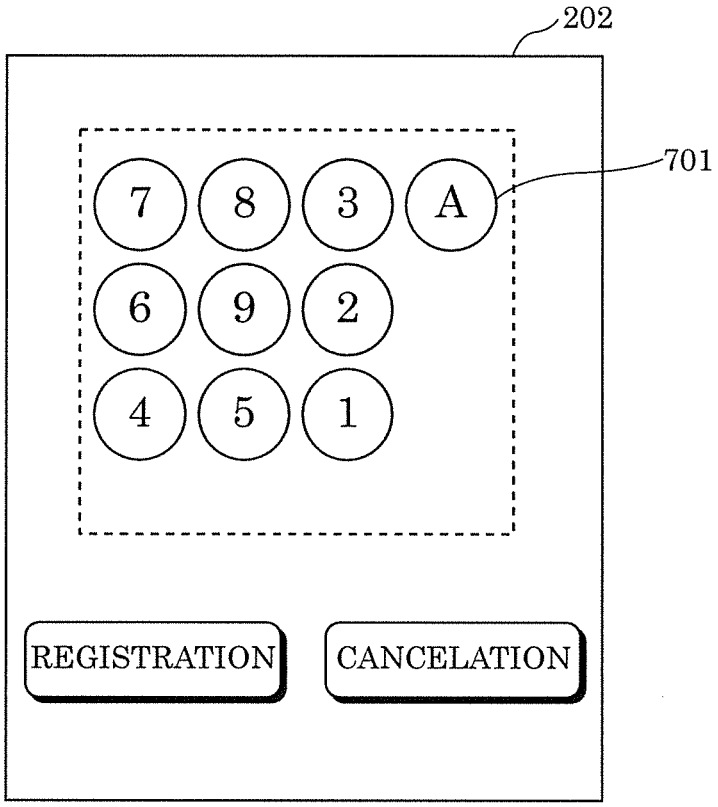
FIG. 7 is a diagram for explaining display on the display unit on which the user selects a target illumination apparatus according to the present embodiment.

FIG. 7 is a diagram for explaining display on display unit 202 on which the user selects target illumination apparatus 10 according to the present embodiment. FIG. 7 is an example of the display on display unit 202 at step S103 in FIG. 3.

As illustrated in FIG. 7, display unit 202 displays illumination icons 701 of respective illumination apparatuses 10 with which control apparatus 20 has ever been paired at steps S102 and S202. It should be noted that display unit 202 may display illumination icons 701 at any given positions on display unit 202. For example, it is possible to display illumination icons 701 of respective paired illumination apparatuses 10 in a chronological order of performing their pairings.

Here, display unit 202 may display only illumination icons 701 of target illumination apparatus(es) 10 which is/are currently paired with control apparatus 20 by communication unit 201 at step S102. In other words, it is possible that display unit 202 does not display the other illumination icons of illumination apparatuses which have previously been paired with control apparatus 20 at step S102 in previous series of processing and for which the pairing has already been registered. In this case, the user can perform following operations only for illumination apparatus(es) 10 for which pairing has not yet been registered. Therefore, there are advantages of easily performing the series of processing only on target illumination apparatus(es) 10 with less operations.

It is also possible that display unit 202 may display illumination apparatuses 10 for which pairing has already been registered in a mode different from that of illumination apparatuses 10 for which pairing has not yet been registered. In this way, the user can also easily perform the series of processing on target illumination apparatus(es) 10 with less operations.

Figure 8:
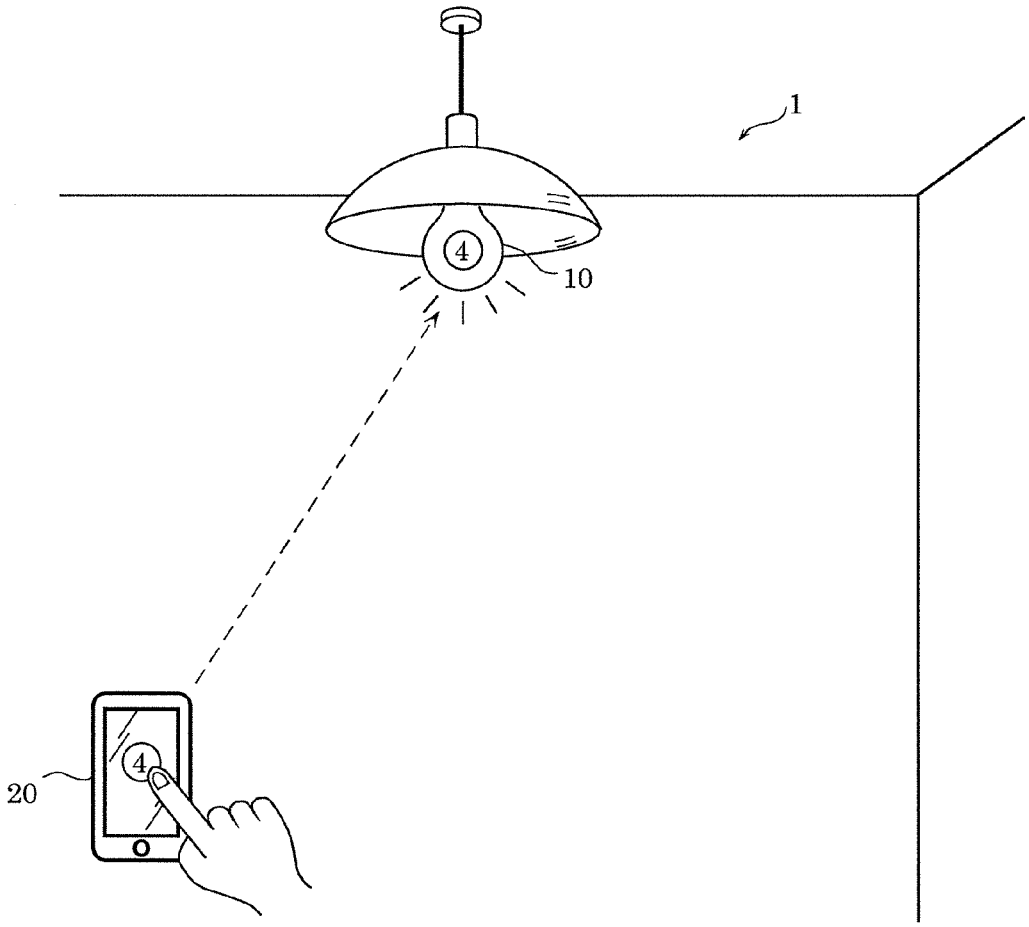
FIG. 8 is an overview illustrating control on a target illumination apparatus according to the present embodiment.

FIG. 8 is an overview illustrating control on target illumination apparatus 10 according to the present embodiment. FIG. 8 illustrates the situation where controller 203 controls target illumination apparatus 10 according to on a user's operation at step S105 in FIG. 3.

As illustrated in FIG. 8, when the user taps on an illumination icon of illumination apparatus 10 having ID of "4" on control apparatus 20, illumination apparatus 10 having ID of "4" blinks. In this way, the blinking of illumination apparatus 10 corresponding to the illumination icon tapped by the user on control apparatus 20 enables the user to confirm which illumination apparatus among illumination apparatuses 10 in an actual space is illumination apparatus 10 corresponding to the tapped illumination icon on control apparatus 20.

Figure 9:
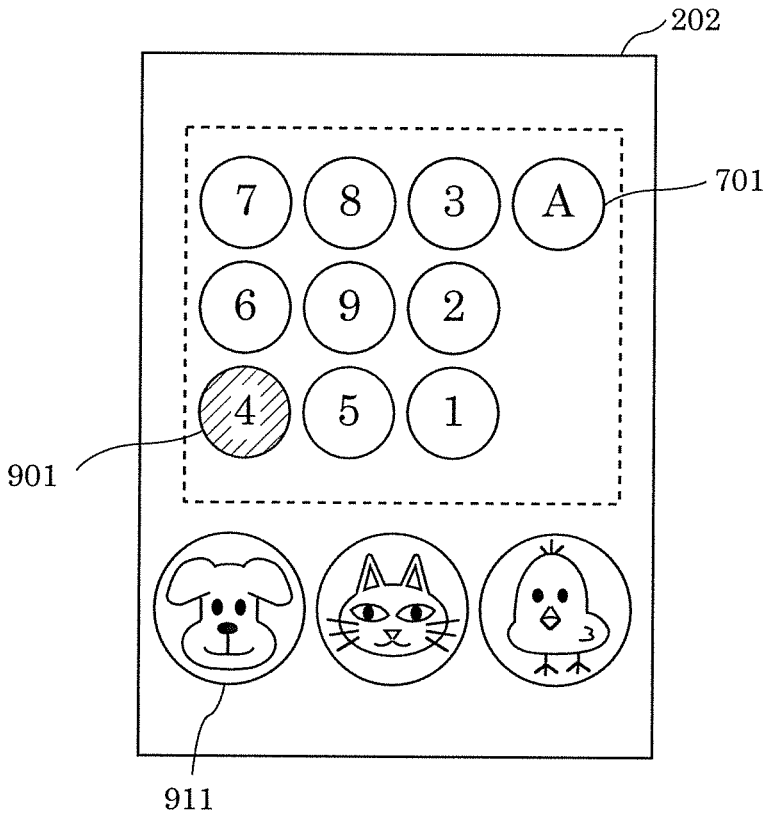
FIG. 9 is a diagram for explaining display on the display unit on which the user selects a group for the target illumination apparatus according to the present embodiment.

FIG. 9 is a diagram for explaining display on display unit 202 on which the user selects a group of target illumination apparatus 10 according to the present embodiment. FIG. 9 is an example of the display on display unit 202 at step S106 in FIG. 3.

As illustrated in FIG. 9, display unit 202 displays illumination icon 901 (illumination icon of target illumination apparatus 10 having ID of "4"), which is tapped by the user at step S104, in the mode different from that of other illumination icons 701, for example, in a different color. Furthermore, display unit 202 displays group identifiers 911 corresponding to respective group candidates to which target illumination apparatus 10 may belong. In this example, group identifiers 911 are expressed as lovely characters such as a dog, a cat, and a bird. It should be noted that such use of characters as group identifiers 911 results from user's tapping on character image button 604 in FIG. 6.

The user taps one of group identifiers 911, to which target illumination apparatus 10 corresponding to illumination icon 901 displayed in the different mode is to belong. Receiver 204 receives the user's tapping on group identifier 911 as selection of a group to which target illumination apparatus 10 is to belong.

If all the group identifiers of the group candidates cannot be displayed at once on display unit 202, display scrolling is introduced to enable the user to view the group identifiers by scrolling the display. Furthermore, it is possible to temporarily reduce in size a display area for the illumination icons, thereby obtaining a larger display area for the group identifiers.

Figure 10:
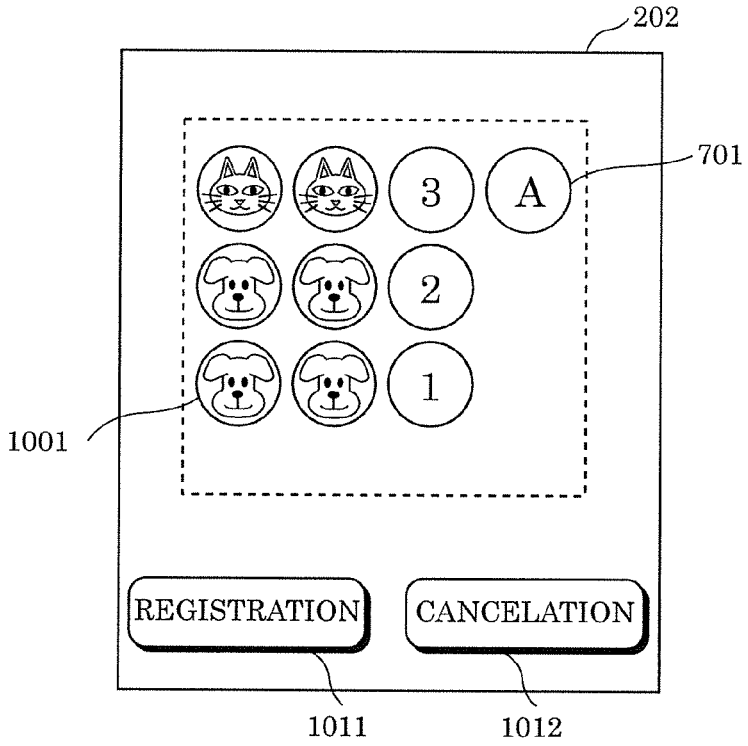
FIG. 10 is a diagram for explaining display on the display unit for showing grouping of the illumination apparatuses according to the present embodiment.

FIG. 10 is a diagram for explaining display on display unit 202 which shows grouping of illumination apparatuses 10 according to the present embodiment. FIG. 10 is an example of the display on display unit 202 at step S109 in FIG. 3.

As illustrated in FIG. 10, display unit 202 replaces illumination icon 901 in FIG. 9 by group identifier 1001 selected for illumination icon 901 tapped at step S104 at the same display position. Display unit 202 also displays registration button 1011 and cancelation button 1012.

Registration button 1011 is a button for receiving user's instruction for registering illumination apparatuses 10 and their group identifiers as currently displayed on display unit 202. When receiver 204 receives user's tapping on registration button 1011, registration unit 205 registers the current group information indicating the selected group identifier(s) and the current connection information indicating the connection partner(s) in the wireless communication. Tapping of registration button 1011 is determined as Yes at step S109 in FIG. 3 and the processing therefore proceeds to step S110.

Viewing the display on display unit 202, the user can learn which group target illumination apparatus 10 is set to belong to, and which illumination apparatuses 10 have not yet been grouped.

Cancelation button 1012 is a button for receiving a user's instruction for canceling a part or all of illumination apparatuses 10 and their group identifiers currently displayed on display unit 202 without being registered. Tapping of cancelation button 1012 is determined as No at step S109 in FIG. 3 and the processing therefore returns to step S104.

Figure 11:
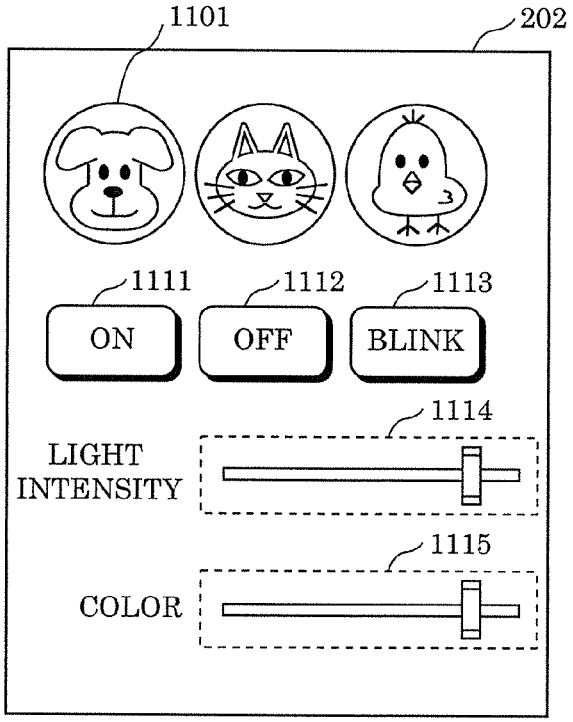
FIG. 11 is a diagram for explaining display on the display unit on which the user controls illumination apparatuses belonging to a target group according to the present embodiment.

FIG. 11 is a diagram for explaining display on display unit 202 on which the user controls illumination apparatuses 10 belonging to respective groups according to the present embodiment. FIG. 11 illustrates an example of the display on display unit 202 in the state where control apparatus 20 can control operations of illumination apparatuses 10 after completion of the series of processing in FIG. 3.

As illustrated in FIG. 11, display unit 202 displays group identifiers 1101. In addition, display unit 202 also displays ON button 1111, OFF button 1112, blink button 1113, light intensity slide bar 1114, and color slide bar 1115. The above-described buttons are referred to also as operation control buttons.

Group identifiers 1101 correspond to respective groups of illumination apparatuses 10 to be controlled by control apparatus 20. The user taps one of group identifiers 1101 which corresponds to a target group for which operation is to be controlled. When receiver 204 receives tapping on one of group identifiers 1101, control apparatus 20 is on standby for operation control on illumination apparatuses 10 belonging to the target group corresponding to tapped group identifier 1101.

The operation control buttons are buttons for receiving a user's operation for control on illumination apparatuses 10 belong to a target group corresponding to tapped group identifier 1101. If receiver 204 receives tapping on one of the operation control buttons while control apparatus 20 is in the above standby state, controller 203 transmits an instruction of operation corresponding to the tapped operation control button.

ON button 1111 is a button for receiving a user's operation for causing illumination apparatuses 10 to be switched ON. If receiver 204 receives tapping on ON button 1111 while control apparatus 20 is in the above standby state, controller 203 transmits an instruction for switching ON illumination apparatuses 10 in the target group corresponding to tapped group identifier 1101. As a result, all illumination apparatuses 10 in the target group receive the instruction and are thereby switched ON.

OFF button 1112 is a button for receiving a user's operation for switching OFF illumination apparatuses 10 in a target group. If receiver 204 receives tapping on OFF button 1112 while control apparatus 20 is in the above standby state, all illumination apparatuses 10 in the target group receive the instruction corresponding to OFF button 1112 and are thereby switched OFF in the similar manner to the above. Blinking button 1113 is a button for receiving a user's operation for blinking illumination apparatuses 10 in a target group. If receiver 204 receives tapping on blink button 1113 while control apparatus 20 is in the above standby state, all illumination apparatuses 10 in the target group receive the instruction corresponding to blink button 1113 and thereby blink in the similar manner to the above.

Light intensity slide bar 1114 is a slide bar for receiving a user's operation for changing light intensity of illumination apparatuses 10 in a target group corresponding to tapped group identifier 1101. If receiver 204 receives user's sliding of light intensity slide bar 1114 while control apparatus 20 is in the above standby state, controller 203 transmits the instruction for changing light intensity of illumination apparatuses 10 in the target group according to the user's operation. As a result, all illumination apparatuses 10 in the target group receive the instruction, and change their light intensity as instructed. Color slide bar 1115 is a slide bar for receiving a user's operation for changing light color of illumination apparatuses 10 in a target group corresponding to tapped group identifier 1101. If receiver 204 receives user's sliding of color slide bar 1115 while control apparatus 20 is in the above standby state, controller 203 transmits the instruction for changing light color of illumination apparatuses 10 in the target group according to the user's operation. As a result, all illumination apparatuses 10 in the same target receive the instruction, and change their light color as instructed.

As a result, the user can control a plurality of illumination apparatuses 10 belonging to the same group together, without controlling each of illumination apparatuses 10 in the same group by separate operations.

Figure 12:
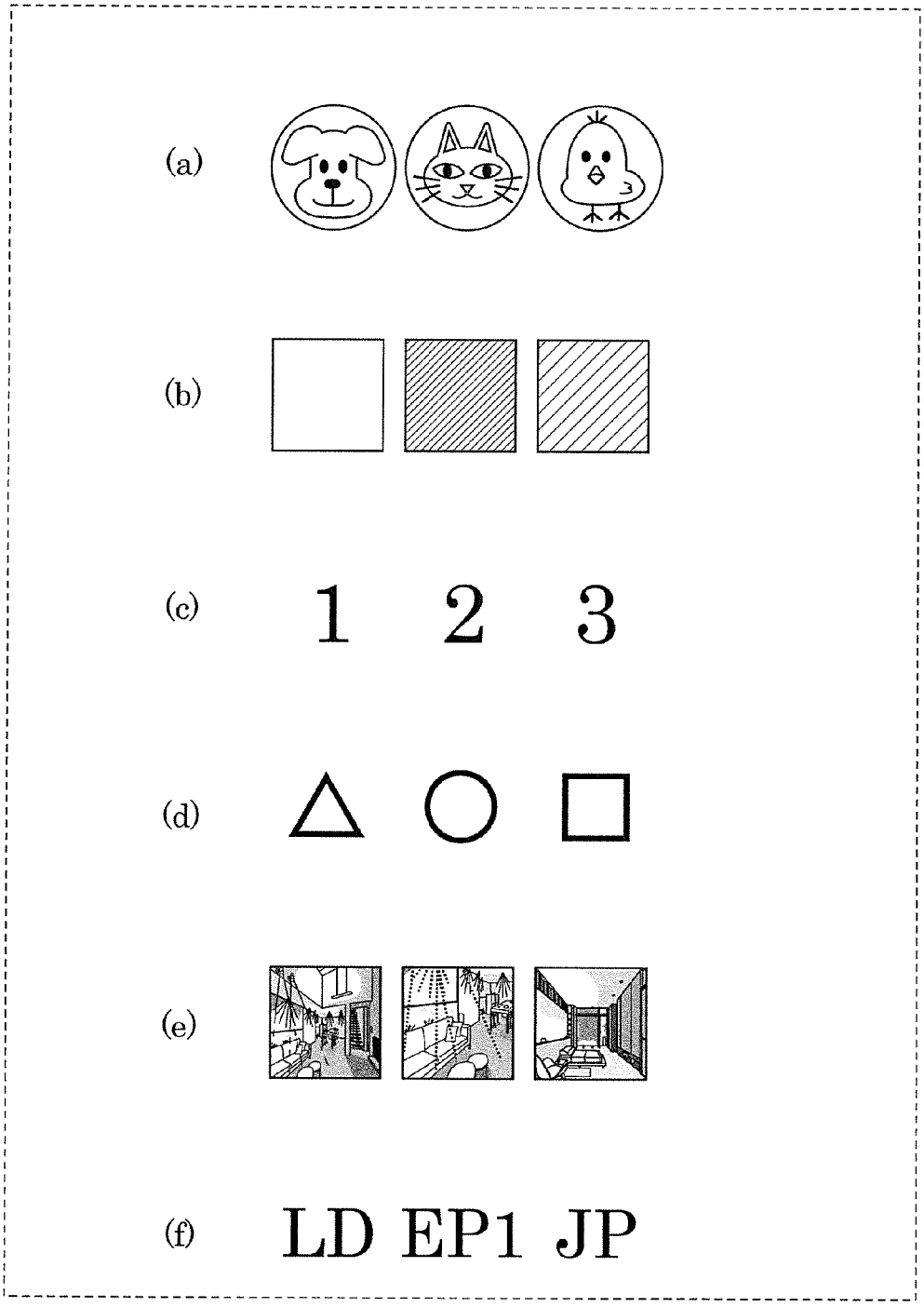
FIG. 12 is a diagram for explaining an example of group identifiers used in the control apparatus according to the present embodiment.

FIG. 12 is a diagram for explaining an example of group identifiers used in control apparatus 20 according to the present embodiment. Although it has been described above that a type representing the group identifiers is a character image, other types representing the group identifiers are also possible and their examples will be also described in detail.

(a) in FIG. 12 is an example of group identifiers expressed as character images. The group identifiers as character images are, for example, images of lovely animals such as a dog, a cat, and a bird. The use of such lovely animal images enables users in a wide age range including children and the aged to control illumination apparatuses 10 by intuitively using control apparatus 20.

(b) in FIG. 12 is an example of group identifiers expressed as colors or patterns. The group identifiers expressed as colors or patterns are, for example, figures in different colors, such as white, red, and blue, or figures without hatching and with different density hatchings. The use of such figures enables users incapable of distinguishing fine patterns to control illumination apparatuses 10 by using control apparatus 20 without confusing the figures.

(c) in FIG. 12 is an example of group identifiers expressed as numerals. The use of such numerals enables users in regions using various different languages to control illumination apparatuses 10 by using control apparatus 20 with less information amount.

(d) in FIG. 12 is an example of group identifiers expressed as symbols or figures. The use of symbols or figures enables users in regions using various different languages to control illumination apparatuses 10 by using control apparatus 20.

(e) in FIG. 12 is an example of group identifiers expressed as images. The images may be photographs or illustrations of rooms in which illumination apparatuses 10 are actually provided, or photographs or illustrations corresponding to the respective rooms. The use of such images enables the user to control illumination apparatuses 10 by imagining places of illumination apparatuses 10.

(f) in FIG. 12 is an example of group identifiers expressed as names of places where illumination apparatuses are provided. The place names may be names of rooms in which illumination apparatuses 10 are actually provided. The use of place names enables the user to control illumination apparatuses 10 by intuitively imagining the places where illumination apparatuses 10 are provided.

[5. Conclusion]

As described above, according to an aspect of the present embodiment, there is provided illumination control system 1 including: a plurality of illumination apparatuses 10; and control apparatus 20 that controls illumination apparatuses 10, wherein each of illumination apparatuses 10 includes: communication unit 101 that performs wireless communication with control apparatus 20; and controller 102 that receives from control apparatus 20 an instruction on an operation of illumination apparatus 10 via communication unit 101, and causes illumination apparatus 10 to perform the operation according to the instruction received, and control apparatus 20 includes: communication unit 201 capable of performing the wireless communication with illumination apparatuses 10 individually, communication unit 201 establishing connection for the wireless communication with target illumination apparatus 10 among illumination apparatuses 10 and perform the wireless communication with target illumination apparatus 10; display unit 202 that displays an icon representing target illumination apparatus 10 that is a partner in the connection established; controller 203 that transmits an instruction on an operation of target illumination apparatus 10 via communication unit 201 to enable a user to visually confirm target illumination apparatus 10; receiver 204 that receives from the user an identifier for identifying a group which is associated with the icon, the group being a unit for controlling one or more illumination apparatuses 10 including target illumination apparatus 10 among illumination apparatuses 10; and registration unit 205 that registers group information and connection information in association with each other when receiver 204 receives the identifier, the group information indicating the group identified by the identifier received by receiver 204, and the connection information indicating the connection established by communication unit 201.

With the above configuration, in illumination control system 1, it is possible to generate and then register both connection information and group information for target illumination apparatus 10 in the same series of processing according to user's instructions. In such a series of processing, the user is prompted to generate the group information of target illumination apparatus 10, subsequent to connection establishment of target illumination apparatus 10 during the same processing. Here, since the generation of group information is not performed for other illumination apparatuses except target illumination apparatus 10, illumination control system 1 enables user's operations to be simpler. Accordingly, illumination control system 1 is capable of enabling the user to generate and register the connection information and the group information of target illumination apparatus 10 by simpler operations.

For example, it is possible that communication unit 201 establishes the connection for the wireless communication with target illumination apparatus 10 and perform the wireless communication with target illumination apparatus 10 as the partner in the connection established, target illumination apparatus 10 being an illumination apparatus for which the group information and the connection information have not yet been registered.

With the above configuration, in illumination control system 1, connection establishment for wireless communication is performed for target illumination apparatus 10 for which control apparatus 20 has not yet register group information and connection information, and then the registering is performed for target illumination apparatus 10. On the other hand, such registering is not performed for illumination apparatuses 10 for which control apparatus 20 has already registered their group information and connection information. Therefore, it is possible to simplify user's operations.

For example, it is further possible that controller 203 transmits an instruction for causing target illumination apparatus 10 to blink to cause target illumination apparatus 10 to blink to enable the user to visually confirm target illumination apparatus 10.

With the above configuration, in illumination control system 1, illumination apparatus 10 is caused to blink when designated as target illumination apparatus 10 to be grouped in group information generation. As a result, the user can visually confirm blinking target illumination apparatus 10, distinguishing it from the other illumination apparatuses. The blinking of illumination apparatus 10 enables the user to surely confirm blinking illumination apparatus 10 as target illumination apparatus 10 for which group information is to be generated.

For example, it is still further possible that controller 203 further: (i) transmits, prior to the registering, an instruction for switching ON target illumination apparatus 10 to switch ON target illumination apparatus 10; and (ii) transmits, after successful completion of the registering, an instruction for switching OFF target illumination apparatus 10 to switch OFF target illumination apparatus 10.

With the above configuration, in illumination control system 1, switching ON and OFF of target illumination apparatus 10 can notify the user whether or not control apparatus 20 appropriately performs and successfully completes the registering for target illumination apparatus 10. The user, who is notified whether or not the registering is appropriately performed and successfully completed, is able to perform appropriate operation afterwards. As a result, usability is improved.

For example, it is still further possible that controller 203 further transmits an instruction for a predetermined operation via communication unit 201 to the one or more illumination apparatuses 10 belonging to the group indicated in the group information that has been registered by registration unit 205, to cause the one or more illumination apparatuses 10 to perform the predetermined operation.

With the above configuration, in illumination control system 1, the same operation control can be performed on all illumination apparatuses 10 belonging to a target group according to the registered group information. Since it is not necessary to individually control operations of respective illumination apparatuses 10, the user can control illumination apparatuses 10 together by simpler operations.

For example, it is still further possible that the predetermined operation caused by controller 203 to be performed by the one or more illumination apparatuses 10 belonging to the group includes switching ON, switching OFF, blinking, changing light intensity, and changing light color.

With the above configuration, in illumination control system 1, illumination apparatuses 10 belonging to the target group can be controlled to be switched ON, switched OFF, blink, change light intensity, and change light color.

For example, it is still further possible that the identifier is expressed as at least one of a character image, a color, a numeral, a figure, a symbol, an image, and a letter.

With the above configuration, in illumination control system 1, the user can generate group information of illumination apparatus 10, in other words, select a group of illumination apparatus 10, by using the identifier which the user can intuitively understand.

According to another aspect of the present embodiment, there is provided control apparatus 20 that controls a plurality of illumination apparatuses 10, plurality of illumination apparatuses 10 each including: communication unit 101 that performs wireless communication with control apparatus 20; and controller 102 that receives from control apparatus 20 an instruction on an operation of illumination apparatus 10 via communication unit 101, and causes illumination apparatus 10 to perform the operation according to the instruction received, and control apparatus 20 comprising: communication unit 201 capable of performing the wireless communication with illumination apparatuses 10 individually, communication unit 201 establishing connection for the wireless communication with target illumination apparatus 10 among illumination apparatuses 10 and perform the wireless communication with target illumination apparatus 10; display unit 202 that displays an icon representing target illumination apparatus 10 that is a partner in the connection established; controller 203 that transmits an instruction on an operation of target illumination apparatus 10 via communication unit 201 to enable a user to visually confirm target illumination apparatus 10; receiver 204 that receives from the user an identifier for identifying a group which is associated with the icon, the group being a unit for controlling one or more illumination apparatuses 10 including target illumination apparatus 10 among illumination apparatuses 10; and registration unit 205 that registers group information and connection information in association with each other when receiver 204 receives the identifier, the group information indicating the group identified by the identifier received by receiver 204, and the connection information indicating the connection established by communication unit 201.

This offers the same effects as illumination control system 1 described previously.

According to still another aspect of the present embodiment, there is provided an illumination control method used by illumination control system 1 including: a plurality of illumination apparatuses 10; and control apparatus 20 that controls illumination apparatuses 10, illumination apparatuses 10 each including: communication unit 101 that performs wireless communication with control apparatus 20; and controller 102 that receives from control apparatus 20 an instruction on an operation of illumination apparatus 10 via communication unit 101, and causes illumination apparatus 10 to perform the operation according to the instruction received, control apparatus 20 including communication unit 201 capable of performing the wireless communication with illumination apparatuses 10 individually, the illumination control method comprising: establishing connection for the wireless communication between control apparatus 20 and target illumination apparatus 10 among illumination apparatuses 10 and performing the wireless communication between control apparatus 20 and target illumination apparatus 10; displaying an icon representing target illumination apparatus 10 that is a partner of control apparatus 20 in the connection established; transmitting an instruction on an operation of target illumination apparatus 10 via communication unit 201 to enable a user to visually confirm target illumination apparatus 10; receiving from the user an identifier for identifying a group which is associated with the icon, the group being a unit for controlling one or more illumination apparatuses 10 including target illumination apparatus 10 among illumination apparatuses 10; and registering group information and connection information in association with each other when the identifier is received in the receiving, the group information indicating the group identified by the received identifier, and the connection information indicating the established connection.

This offers the same effects as illumination control system 1 described previously.

Variations

Thus, although the above description has been given for illumination control system 1 according to the present embodiment, the present disclosure is not limited to the embodiment.

It has been described in the above embodiment that, in illumination control system 1, communication between control apparatus 20 and target illumination apparatus 10 is wireless communication. More specifically, for example, the wireless communication may be wireless communication by radio waves, or wireless communication by visible light, infrared rays, or ultraviolet rays. Alternatively, wired communication may be used instead of the wireless communication.

For example, although it has been described in the above embodiment that, in illumination control system 1, light source unit 103 is included in illumination apparatus 10, light source unit 103 may be in an external apparatus connected to illumination apparatus 10. In other words, illumination apparatus 10 may include: an electrical bulb having light source unit 103; and a bulb socket having communication unit 101 and controller 102.

The general and specific aspects according to the above embodiment may be implemented to a system, a method, an integrated circuit, a computer program, and a computer-readable recording medium, such as a Compact Disc-Read Only Memory (CD-ROM), and may be implemented also to a desired combination of them.

Those skilled in the art will be readily appreciate that various modifications and combinations of the structural elements and functions in the embodiment and its variations are possible without materially departing from the novel teachings and advantages of the present disclosure. Accordingly, all such modifications and combinations are intended to be included within the scope of the present disclosure.

What is claimed is:

1. An illumination control system comprising: a plurality of illumination apparatuses; and a control apparatus that controls the plurality of illumination apparatuses, wherein each of the plurality of illumination apparatuses includes:

a first communication unit configured to perform wireless communication with the control apparatus; and a first controller that receives from the control apparatus an instruction on an operation of the each of the plurality of illumination apparatuses via the first communication unit, and causes the each of the plurality of illumination apparatuses to perform the operation according to the instruction received, and the control apparatus includes:

a second communication unit configured to be capable of performing the wireless communication with the plurality of illumination apparatuses individually, the second communication unit being configured to establish connection for the wireless communication with a target illumination apparatus among the plurality of illumination apparatuses and perform the wireless communication with the target illumination apparatus;

a display unit configured to display an icon representing the target illumination apparatus that is a partner in the connection established;

a second controller that transmits an instruction on an operation of the target illumination apparatus via the second communication unit to enable a user to visually confirm the target illumination apparatus;

a receiver that receives from the user an identifier for identifying a group which is associated with the icon, the group being a unit for controlling one or more illumination apparatuses including the target illumination apparatus among the plurality of illumination apparatuses; and a registration unit configured to register group information and connection information in association with each other when the receiver receives the identifier, the group information indicating the group identified by the identifier received by the receiver, and the connection information indicating the connection established by the second communication unit.

2. The illumination control system according to claim 1, wherein the second communication unit is configured to establish the connection for the wireless communication with the target illumination apparatus and perform the wireless communication with the target illumination apparatus as the partner in the connection established, the target illumination apparatus being an illumination apparatus for which the group information and the connection information have not yet been registered.

3. The illumination control system according to claim 1, wherein the second controller transmits an instruction for causing the target illumination apparatus to blink to cause the target illumination apparatus to blink to enable the user to visually confirm the target illumination apparatus.

4. The illumination control system according to claim 1, wherein the second controller further:

(i) transmits, prior to the registering, an instruction for switching ON the target illumination apparatus to switch ON the target illumination apparatus; and (ii) transmits, after successful completion of the registering, an instruction for switching OFF the target illumination apparatus to switch OFF the target illumination apparatus.

5. The illumination control system according to claim 1, wherein the second controller further transmits an instruction for a predetermined operation via the second communication unit to the one or more illumination apparatuses belonging to the group indicated in the group information that has been registered by the registration unit, to cause the one or more illumination apparatuses to perform the predetermined operation.

6. The illumination control system according to claim 5, wherein the predetermined operation caused by the second controller to be performed by the one or more illumination apparatuses belonging to the group includes switching ON, switching OFF, blinking, changing light intensity, and changing light color.

7. The illumination control system according to claim 1, wherein the identifier is expressed as at least one of a character image, a color, a numeral, a figure, a symbol, an image, and a letter.

8. A control apparatus that controls a plurality of illumination apparatuses, the plurality of illumination apparatuses each including:

a first communication unit configured to perform wireless communication with the control apparatus; and a first controller that receives from the control apparatus an instruction on an operation of the each of the plurality of illumination apparatuses via the first communication unit, and causes the each of the plurality of illumination apparatuses to perform the operation according to the instruction received, and the control apparatus comprising:

a second communication unit configured to be capable of performing the wireless communication with the plurality of illumination apparatuses individually, the second communication unit being configured to establish connection for the wireless communication with a target illumination apparatus among the plurality of illumination apparatuses and perform the wireless communication with the target illumination apparatus;

a display unit configured to display an icon representing the target illumination apparatus that is a partner in the connection established;

a second controller that transmits an instruction on an operation of the target illumination apparatus via the second communication unit to enable a user to visually confirm the target illumination apparatus;

a receiver that receives from the user an identifier for identifying a group which is associated with the icon, the group being a unit for controlling one or more illumination apparatuses including the target illumination apparatus among the plurality of illumination apparatuses; and a registration unit configured to register group information and connection information in association with each other when the receiver receives the identifier, the group information indicating the group identified by the identifier received by the receiver, and the connection information indicating the connection established by the second communication unit.

9. An illumination control method used by an illumination control system including: a plurality of illumination apparatuses; and a control apparatus that controls the plurality of illumination apparatuses, the plurality of illumination apparatuses each including:

a first communication unit configured to perform wireless communication with the control apparatus; and a first controller that receives from the control apparatus an instruction on an operation of the each of the plurality of illumination apparatuses via the first communication unit, and causes the each of the plurality of illumination apparatuses to perform the operation according to the instruction received, and the control apparatus including a second communication unit configured to be capable of performing the wireless communication with the plurality of illumination apparatuses individually, wherein the illumination control method comprising:

establishing connection for the wireless communication between the control apparatus and a target illumination apparatus among the plurality of illumination apparatuses and performing the wireless communication between the control apparatus and the target illumination apparatus;

displaying an icon representing the target illumination apparatus that is a partner of the control apparatus in the connection established;

transmitting an instruction on an operation of the target illumination apparatus via the second communication unit to enable a user to visually confirm the target illumination apparatus;

receiving from the user an identifier for identifying a group which is associated with the icon, the group being a unit for controlling one or more illumination apparatuses including the target illumination apparatus among the plurality of illumination apparatuses; and registering group information and connection information in association with each other when the identifier is received in the receiving, the group information indicating the group identified by the received identifier, and the connection information indicating the established connection.

* * * * *